US007490677B2

(12) United States Patent
Buytaert et al.

(10) Patent No.: US 7,490,677 B2
(45) Date of Patent: Feb. 17, 2009

(54) STABBING GUIDE ADAPTED FOR USE WITH SAVER SUB

(75) Inventors: Jean Buytaert, Mineral Wells, TX (US); Jon Andrew Veverica, Katy, TX (US); Robert Gregory Dieste, Alvin, TX (US); Jeremy R. Angelle, Lafayette, LA (US)

(73) Assignee: Frank's International, Houston, TX (US)

( * ) Notice: Subject to any disclaimer, the term of this patent is extended or adjusted under 35 U.S.C. 154(b) by 40 days.

(21) Appl. No.: 11/428,712

(22) Filed: Jul. 5, 2006

(65) Prior Publication Data

US 2008/0006401 A1 Jan. 10, 2008

(51) Int. Cl.
*E21B 19/18* (2006.01)

(52) U.S. Cl. ..... 166/380; 166/77.51

(58) Field of Classification Search ..... 166/380, 166/77.51, 85.5

See application file for complete search history.

(56) References Cited

U.S. PATENT DOCUMENTS 3,869,150 A 3/1975 Brown
4,621,403 A 11/1986 Babb et al.
5,107,940 A 4/1992 Berry
5,388,651 A 2/1995 Berry
6,591,471 B1 7/2003 Hollingsworth et al.
7,237,607 B2 * 7/2007 Angman et al. ..... 166/85.5
2006/0001549 A1 * 1/2006 Shah et al. ..... 340/854.4

FOREIGN PATENT DOCUMENTS

CA 2116520 8/1995
WO WO 98/48143 10/1998

OTHER PUBLICATIONS

PCT International Search Report, Nov. 2, 2007, 5 pages.
PCT Written Opinion of the International Searching Authority, Nov. 2, 2007, 6 pages.

* cited by examiner

*Primary Examiner*—William P Neuder
(74) *Attorney, Agent, or Firm*—Patrick K. Steele; Streets & Steele

(57) ABSTRACT

An apparatus comprising a saver sub and a stabbing guide having a housing to capture and direct the upwardly disposed threaded end of a tubular joint to the downwardly disposed threaded mating end of the saver sub is disclosed. The stabbing guide is adapted for surrounding and facilitating threaded connection of the saver sub to tubular segments brought within the housing.

27 Claims, 4 Drawing Sheets

STABBING GUIDE ADAPTED FOR USE WITH SAVER SUB

BACKGROUND

1. Field of the Invention

The present invention is directed to a tool for use in drilling earthen wells. The present invention is directed to a stabbing guide adapted for use with a consumable saver sub coupled to the output drive shaft of a top drive.

2. Description of Related Art

A top drive is a hydraulic or electric motor suspended from the derrick of a drilling rig that rotates the drill string and drill bit for drilling a well. Using a top drive eliminates the need for the conventional kelly and rotary table, and it reduces the amount of manual labor and associated hazards that have traditionally accompanied this task. For drilling contractors and casing installers, utilizing top drive technology translates into improved operational efficiency.

Top drives can be used to rotate a tubular segment to threadably make up a connection between the tubular segment and a tubular string that is lowered into a borehole as it is lengthened. Top drives couple to tubular segments with threads, as is shown in FIG. 1. The male threads 4 of the top drive output shaft 3 are threadably received into mating female threads 8 in the upwardly disposed end of the tubular segment 6.

A problem resulting from repeated make up and break out of threaded connections using a top drive is that the threaded male member 4 coupled to the output drive shaft 3 of the top drive 2 becomes worn and damaged with repeated use. Replacement of the threaded male portion 4 of the top drive 2 is expensive and time consuming if the top drive is taken out of service.

A saver sub is a short length of drill collar that serves as an extension for the output drive shaft of the top drive. The saver sub has a threaded male coupling at one end, a threaded female coupling at the other end and a bore there through, and the threaded female end of the saver sub receives and threadably fastens onto the downwardly disposed threaded male member that is coupled to the output drive shaft of the top drive. The opposed threaded male end of the saver sub is received into and threadably fastened to the tubular string that extends into the borehole.

When the hole must be deepened, and when a tubular segment must be joined to lengthen the tubular string, the threaded connection between the saver sub and the rest of the tubular string is disconnected, as opposed to disconnecting the connection between the top drive and the saver sub, so that the connection between the top drive and the saver sub is rarely disconnected and reconnected and, therefore, it endures minimal wear and tear. Although the lower threaded connection between the saver sub and the tubular string is used repeatedly and endures almost all of the wear and tear, the saver sub is designed to be consumable. That is, the saver sub is adapted for periodically being removed from the top drive output drive shaft, re-machined to restore the lower threaded male end to good working order, and the saver sub can be returned to service. Although removal of the damaged threads and re-machining new threads onto the saver sub consumes some of the length of the saver sub, the saver sub may be restored a number of times until it becomes too short to be used. The saver sub is expendable and does not represent a major investment. However, the top drive output drive shaft threads are spared considerable wear and tear by use and restoration of the sacrificial saver sub, and the top drive components represent a significant capital cost and considerable rig downtime when replaced.

A problem that arises from the use of saver subs is the difficulty in obtaining proper alignment of the top drive with the tubular segment to which it is being coupled. As shown in FIG. 2, the tubular segment 7, which can range from 30 to 93 feet in length, may be moved off center alignment with the top drive 2 by wind or by very slight imperfections or wear in the tools used to grip and hold the tubular segment 7 for make up of the connection with the top drive 2. The top drive 2 is extremely heavy and advances downwardly with great force. Consequently, misalignment of the top drive 2 and the tubular segment 7 when attempting to make up the connection between the two can result in substantial damage. Plastic deformation resulting from misaligned impact may cause leaks in the pipe string due to damage to the sealing surfaces 9 of the threaded connection.

What is needed is a tool for preventing misalignment upon introduction of the top drive saver sub into the connection on the tubular segment. What is needed is a tool for reliably aligning the tubular segment with the top drive saver sub so that the threaded connection can be made up without damage to the connection.

SUMMARY OF THE PRESENT INVENTION

The present invention achieves these objections and is directed to an inverted stabbing guide adapted for use with a saver sub on a top drive unit. The stabbing guide of the present invention may be specifically adapted to capture the upwardly disposed end of a tubular segment within a generally converging or within a generally frustoconical housing and, upon relative vertical movement of the top drive toward the tubular segment, to guide the threaded connection at the upwardly disposed end of the tubular segment into alignment with the downwardly disposed threaded male connection of the saver sub that extends downwardly from the top drive. The stabbing guide facilitates make up of the connection between the top drive and the tubular segment without damage to the tubular segment from misaligned impact with the top drive. The stabbing guide of the present invention is adapted for use with saver subs that are adapted for being removed, re-machined to restore the threaded connection on the downwardly disposed end. In one embodiment, the stabbing guide of the present invention may be rotatably locked to the saver sub to permit removal or installation of the saver sub and the stabbing guide as a unit. In another embodiment, the stabbing guide of the present invention may be truncated to expose a portion of the saver sub nearest its threaded coupling to the top drive to facilitate gripping of the saver sub to permit removal or installation of the saver sub. In the latter embodiment, the stabbing guide may be rotatably received on the saver sub.

BRIEF DESCRIPTION OF THE DRAWINGS

A more particular description of embodiments of the present invention briefly summarized above may be had by references to the embodiments which are shown in the drawings which form a part of this specification. These drawings illustrate certain preferred embodiments and are not to be used to improperly limit the scope of the invention which may have other equally effective or legally equivalent embodiments.

DETAILED DESCRIPTION OF THE PRESENT INVENTION

Figure 1:
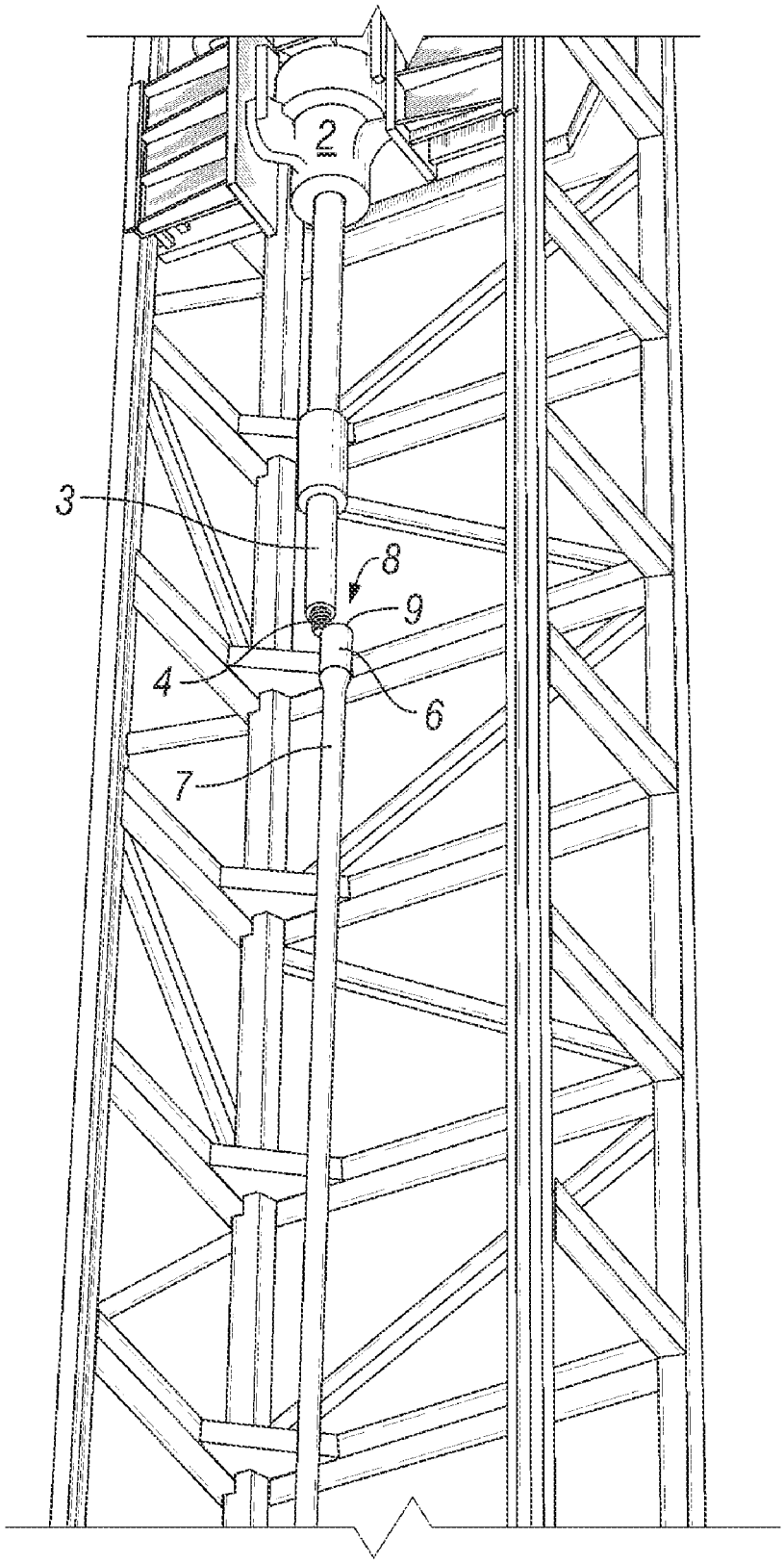
FIG. 1 is a prospective view of a top drive having a downwardly disposed male threaded connection misaligned with an upwardly disposed female connection.

FIG. 1 is a prospective view of a top drive 2 having a downwardly disposed and externally threaded male member 4 ready for insertion and make up with an upwardly disposed internally threaded female member 6. The top drive 2 is generally vertically reciprocable using a block and draw-works (not shown). The block is lowered so that the externally threaded male member 4 engages the internally threaded female member 6, and the connection can be made by rotation of the male member 4 using the top drive 2 until a threshold torque is achieved. Damage to the sealing surface 9 of the connection can occur because the female member 6 on the upwardly disposed end of a tubular segment 7 may be mis-aligned with a downwardly descending male member 4 on the output drive shaft 3 of a top drive 2. An impact of the male member 4 with the internal threads 8, or with the landing 9 around the threads 8 of the female member 6, may damage the sealing capacity of the connection that results from make up of the male member 4 and the female member 6, thereby putting the success of the drilling or completion operation at risk.

Figure 2:
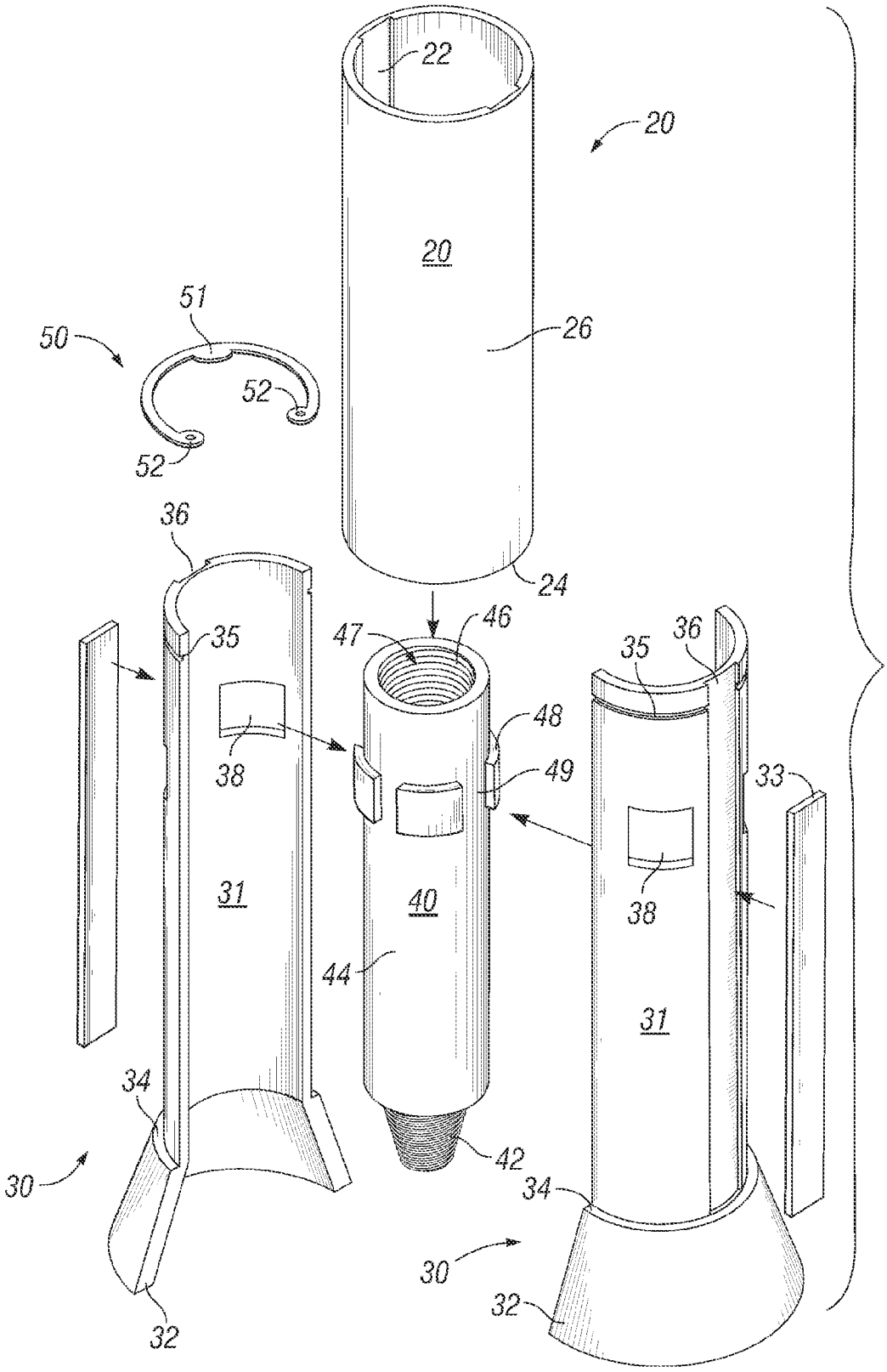
FIG. 2 is an exploded view of the stabbing guide of the present invention.

The present invention prevents this risk. FIG. 2 is an exploded view of one embodiment of the apparatus of the present invention. The apparatus comprises a saver sub 40 having a downwardly disposed threaded male member 42 at its lower end and an upwardly disposed and internally threaded female member 46 at its upper end, with a fluid bore 47 there between for accommodating the flow of drilling fluid introduced from the bore of the top drive (not shown in FIG. 2—see FIG. 1) and directed through the tubular string. The embodiment of the present invention shown in FIG. 2 comprises a saver sub 40 having an elongated shaft 44 between the female member 46 and the male member 42, and one or more radially outwardly protrusions 48 disposed on the shaft 44 near the end with the female member 46. The protrusions on the shaft 44 are adapted for being received into windows 38 in the sleeve portion 31 of the halves 30 that together make up the stabbing guide, as will be shown and discussed later in relation to FIG. 3.

The apparatus further comprises a stabbing guide comprising a pair of elongated stabbing guide halves 30, each of which has an elongated sleeve portion 31 and a housing 32, the sleeve portion 31 and the housing 32 coupled at shoulder 34. Each stabbing guide half 30 has a longitudinal locking groove 36 extending along the length of the sleeve portion 31 from the shoulder 34 to the opposite end of the sleeve portion 31. The locking groove 36 is adapted for rotatably aligning with a mating longitudinal groove 22 in the interior wall of the locking sleeve 20. The locking sleeve 20 is adapted for being slidably received onto the halves 30 after the halves 30 are assembled to form the stabbing guide (see element 29 in FIG. 3) that surrounds the saver sub 40 within the sleeve portion 31 of the stabbing guide 29.

Figure 3:
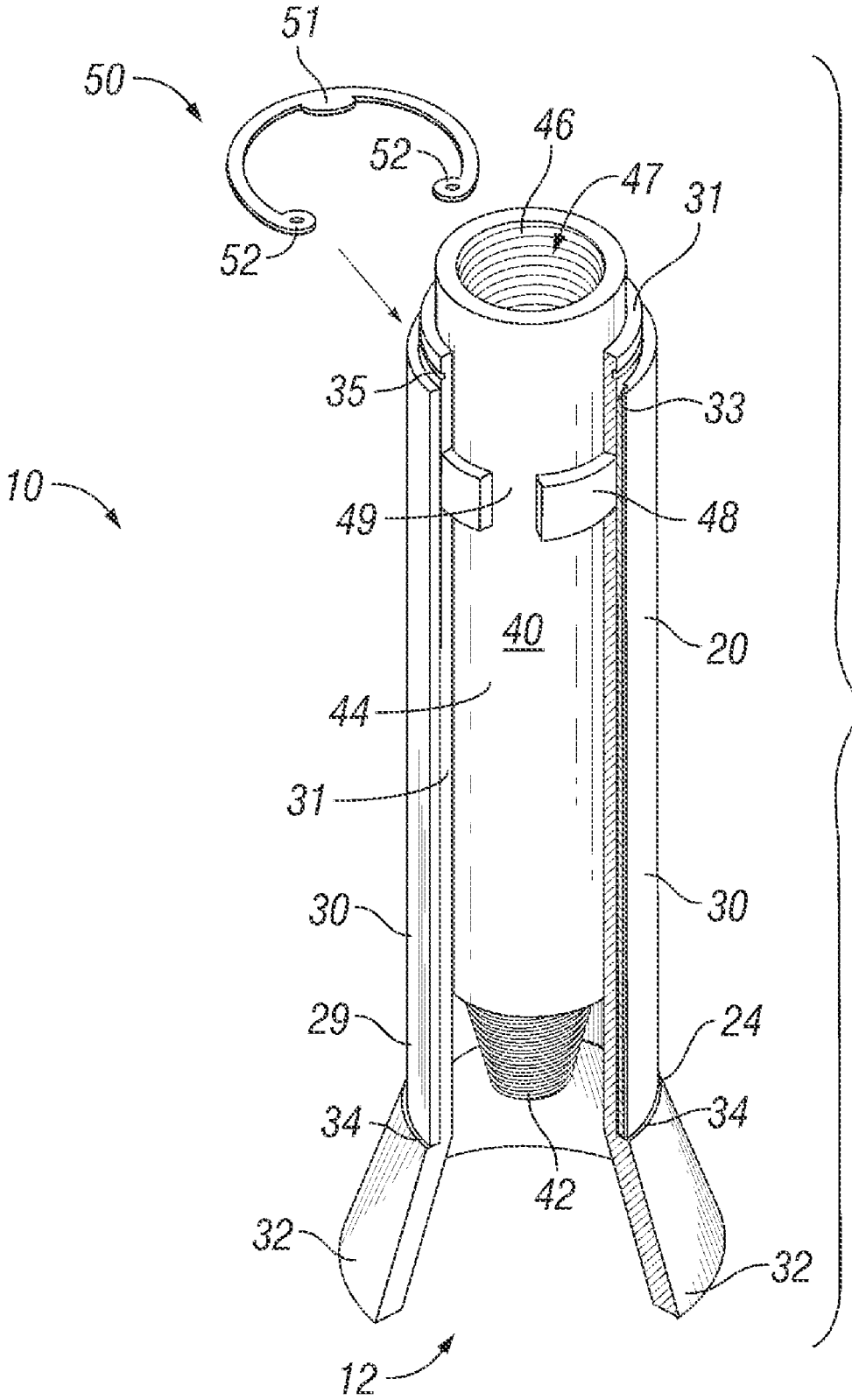
FIG. 3 is a partial cross-sectional view of an assembled stabbing guide of the present invention.

FIG. 3 is a partial cross-sectional view of the assembled stabbing guide 29 and saver sub 40 shown in FIG. 2. The saver sub 40 is surrounded by the assembled stabbing guide 29 formed by assembly of the stabbing guide halves 30. The threaded male member 42 of the saver sub 40 is shown captured within the sleeve portion 31 of the stabbing guide halves 30, and is centered within the sleeve portion 31 adjacent to or above the shoulder 34 and the housing 32 to receive and connect with the upwardly disposed and internally threaded female connection (see element 6 in FIG. 1) of tubular segment (see element 7 in FIG. 1). The protrusions 48 of the saver sub 40 are shown in position to be received within the windows (see element 38 of FIG. 2) to rotatably lock the saver sub 40 to the stabbing guide 29.

The stabbing guide halves 30 of the stabbing guide 29 are shown captured in their assembled configuration in FIG. 3 by the locking sleeve 20. The locking sleeve 20 is slidably received onto the generally cylindrical exterior surface of the sleeve portion 31 of the stabbing guide 29. The locking sleeve 20 is captured in its locking position around the stabbing guide 29 by fitting E-clip 50 around the stabbing guide 29 into circumferential groove 35 immediately below the top end 31 of the stabbing guide 29.

The locking sleeve 20 may be rotatably interlocked with the stabbing guide 29 using the locking bars 33 received within the elongated keyways formed by alignment of longitudinal grooves 36 in the stabbing guide 29 with internal longitudinal grooves 22 on the interior wall of the locking sleeve 20. As shown in FIG. 3, the locking bars 33 partially extend within the groove 36 and also into the adjacent aligned groove 22 to prevent rotation of the locking sleeve 20 relative to the stabbing guide 29. The rotatable locking relationship between the locking sleeve 20 with the stabbing guide 29, and also of the stabbing guide 29 with the saver sub 40, enables the removal of the entire assembly as it is shown in FIG. 3 from its connected position on the downwardly disposed and externally threaded male member (see element 4 of FIG. 1) of the top drive (see element 2 of FIG. 1) by rotation of the entire locked assembly 10 to unthread the connection between the female member 46 of saver sub 40 with the mating male member (see element 4 of FIG. 1) protruding downwardly from the top drive (see element 2 in FIG. 1). The external cylindrical surface 26 of the locking sleeve 20 can be gripped and rotated using a power tong to remove or reinstall the assembly 10.

Figure 4:
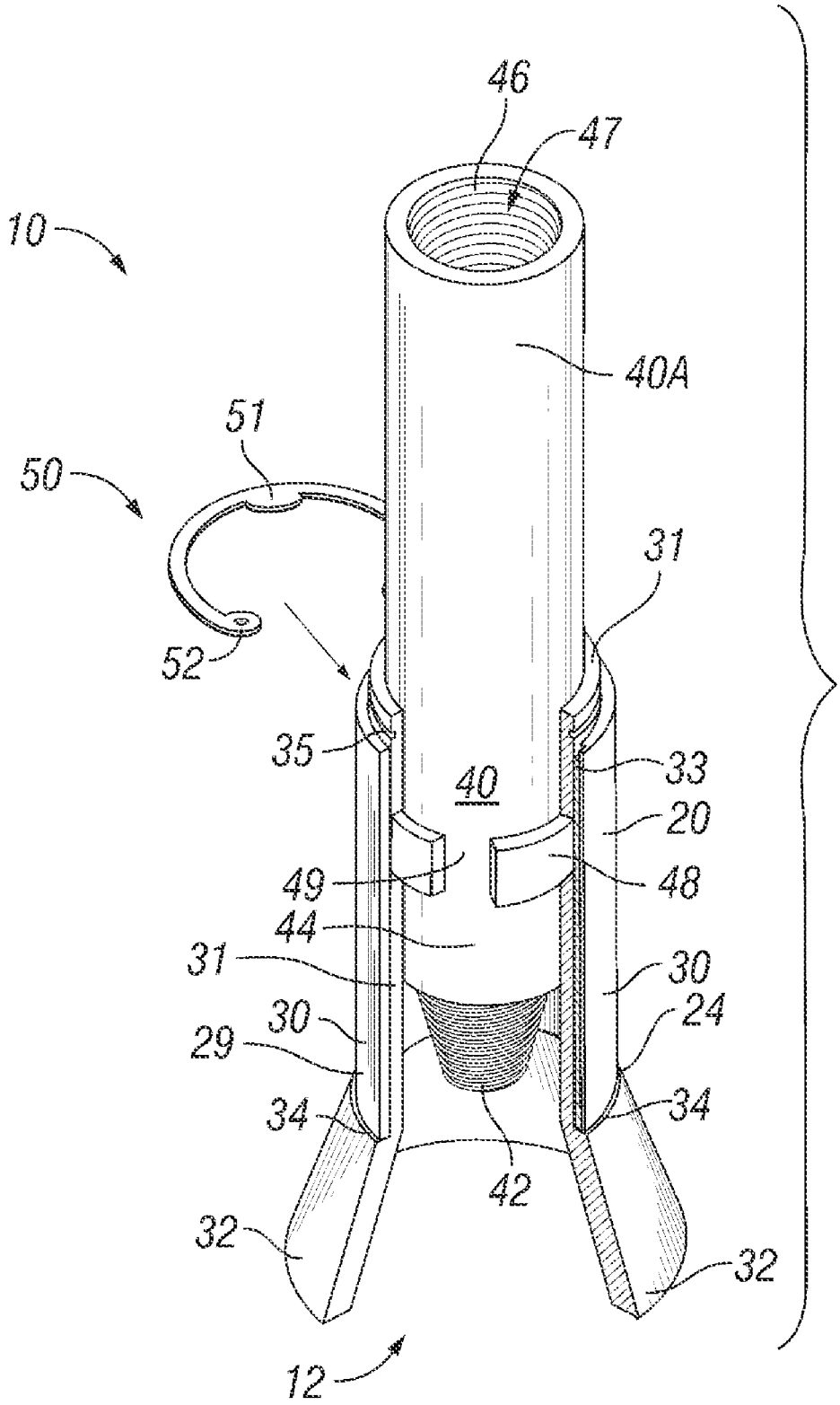
FIG. 4 is a partial cross-sectional view of an assembled alternate embodiment of the stabbing guide of the present invention.

FIG. 4 is a partial cross-sectional view of an assembled alternate embodiment of the stabbing guide of the present invention. In this alternate embodiment, the stabbing guide 29 may be, but is not necessarily rotatably secured to the saver sub 40. The halves 30 have truncated sleeve portions 31 to form a shorter stabbing guide 29 and to expose a bare portion 40A of the saver sub 40. This embodiment allows the saver sub 40 to be threadably coupled at the threaded female member 46 to a top drive or power swivel (not shown) by securing the saver sub 40 against rotation at the bare portion 40A and then by rotating the top drive to couple the saver sub 40 to the top drive. The halves 30 in this alternative embodiment may be secured one to the other to contain at least a portion of the saver sub 40 within the truncated sleeve formed by the halves. The halves 29 may be coupled together to form the stabbing guide 29 using a locking sleeve, as described above in connection with FIG. 3, or any of a number of methods known in the art for securing two generally semi-circular members together to form a bore therein.

In another embodiment, the stabbing guide of the alternate embodiment may be rotatably secured to the saver sub by forming a circumferential ridge on the saver sub and by forming half (180 degrees) of a cooperating circumferential groove within each half of the stabbing guide. When assembled, the stabbing guide would provide a full circumferential groove for receiving and cooperating with the circumferential ridge on the saver sub.

The advantage of truncating the sleeve portions 31 of the stabbing guide as shown in FIG. 4 is that a portion of the saver sub 40 is exposed for gripping to facilitate the make up of the threaded connection between the saver sub 40 and the top drive. The disadvantage of truncating the sleeve portion 31 of the stabbing guide is that it may limit the number of times that the saver sub 40 can be removed, reconditioned, rethreaded and reused along with a stabbing guide. That is, truncating the sleeve portion effectively shortens the consumable portion of the saver sub 40 because the portion of the saver sub 40 used for securing the stabbing guide, whether it be protrusions received into windows, as shown in FIGS. 2 and 3, or a circumferential ridge received within a circumferential groove, is necessarily closer to the lower threaded male connection 42 of the saver sub 40.

The present invention can be utilized with a stabbing guide that comprises a unitary structure or one that comprises two or more portions assembled together to form a stabbing guide, as is shown in FIGS. 2 and 3. The stabbing guide comprising two portions has certain advantages over a unitary stabbing guide. For example, the two-part stabbing guide is easy to assemble and to secure onto the saver sub, but it also has additional parts that may become detached and lost. However, the foregoing disclosure should not be deemed as limiting of the present invention to a stabbing guide having two halves, or to a stabbing guide having more than one part. Similarly, there are variations in the structures that can be used to interlock the locking sleeve to the stabbing guide and also to interlock the stabbing guide to the saver sub. Various pins, clips, retainers, latches, sleeves, bands and mating sockets can be substituted for the interlocking structures disclosed above for rotatably and/or axially securing the components of the present invention one to the other(s).

The foregoing disclosure should not been deemed as limiting of the present invention to the use of protrusions on the saver sub received in windows in the sleeve portion of the stabbing guide to rotatably interlock these two structures, or to the use of aligned grooves and locking bars to rotatably interlock the stabbing guide and the locking sleeve. However, since the saver sub has a fluid bore for delivering pressurized fluid to the bore of the tubular string, the use of structures and devices for rotatably or axially securing structures should not compromise the load bearing, fluid flow or torque transfer capacity of the sub saver.

The word "sleeve," as it is used herein, should be given its broad meaning, and may comprise a ring or a band. The word "window," as used herein, includes recesses machined into the wall of a structure to a depth sufficient to accommodate the protrusion on the saver sub, and does not necessarily require a complete removal of the material adjacent to the recess to form an aperture.

The word "locking," as used herein, is not meant to require absolute prevention of axial movement of one structure relative to the other, but may allow some limited movement while preventing substantial axial movement of one structure relative to the other. For example, the windows within the halves 30 of the stabbing guide 29 may be vertically longer than the protrusions 48 extending outwardly from the saver sub 40 and captured within the windows to rotatably lock the stabbing guide 29 to the saver sub 40. This will allow the stabbing guide to be axially displaced upwardly relative to the saver sub to avoid damage to the landing 8 of the female connection 6 of the tubular joint 7 upon impact with the stabbing guide 29. This embodiment of the present invention provides for vertical movement of the stabbing guide 29 relative to the saver sub 3 and the top drive 2, thereby giving visual notice to rig personnel of top drive misalignment with the tubular joint 7.

The word "housing," as used herein, should not be limited to the generally frustoconical configuration shown in FIGS. 2 and 3, and may be any of various shapes that are adapted to capture and centrally direct a tubular segment to the sleeve portion of the stabbing guide as the top drive is lowered toward the tubular segment as described above. The housing may have a generally square or triangular cross-section, or any of a number of other shapes, but is generally convergent from its base to its top. The term "top drive," as that term is used herein, is not limited to a top drive unit, and includes a casing running tool, a power swivel, and all other devices that have a downwardly disposed and rotatable portion that can be used to make up a threaded connection between a saver sub and a segment of pipe.

In conclusion, therefore, it is seen that the present invention and the embodiments disclosed herein and those covered by the appended claims are well adapted to carry out the objectives and obtain the benefits set forth above. Certain changes may be made in the subject matter without departing from the spirit and the scope of this invention. It is realized that changes are possible within the scope of this invention and it is further intended that each element or step recited in any of the following claims is to be understood as referring to all equivalent elements or steps.

What is claimed is:

1. An apparatus to make-up connections with a top drive on a rig comprising:

a saver sub having a first end and a second end, the first end having a threaded female member connectable to a top drive and the second end having a threaded male member connectable to a tubular segment;

a stabbing guide to receive and align the end of the tubular segment, the stabbing guide having an elongated sleeve portion at a first end to receive the threaded male member at the second end of the saver sub and a housing at a second end to direct a female connection of the tubular segment to the threaded male member of the saver sub; and one or more radially projecting protrusions on the saver sub receivable within one or more recesses in the sleeve portion of the stabbing guide to rotatably secure the saver sub to the stabbing guide; and one or more radially projecting protrusions on the saver sub receivable within one or more recesses in the sleeve portion of the stabbing guide to rotatably secure the saver sub to the stabbing guide;

wherein the housing directs a tubular joint connection into contact with the male member at the second end of the saver sub to facilitate rotatably making up the connection between the saver sub and the tubular joint.

2. The apparatus of claim 1 wherein the recesses in which the one or more radially projecting protrusions on the saver sub may be received are open to form one or more windows in the sleeve portion of the stabbing guide.

3. The apparatus of claim 1 wherein the one or more recesses in the sleeve portion of the stabbing guide are longer in the axial direction than the protrusions on the saver sub that are received into the recesses to rotatably lock the saver sub to the stabbing guide and to limit vertical movement of the stabbing guide relative to the saver sub.

4. The apparatus of claim 1 further comprising a locking sleeve slidably received to capture the stabbing guide in its position surrounding the saver sub.

5. The apparatus of claim 4 further comprising:

an arrangement of at least one spline received within at least one groove to rotatably secure the stabbing guide to the locking sleeve wherein rotation of the locking sleeve rotates the stabbing guide and the saver sub received therein.

6. The apparatus of claim 1 wherein the housing is generally frustoconical.

7. The apparatus of claim 1 wherein the housing is vertically movable relative to the saver sub.

8. The apparatus of claim 7 wherein the housing is biased to its downward position.

9. The apparatus of claim 1 wherein the threaded male member of the second end of the saver sub is adapted for being reconditioned and rethreaded after sustaining mechanical deformation or wear.

10. An apparatus for use in making up connections using a top drive comprising:

a saver sub comprising an elongated drill collar having a fluid bore, an upper threaded connection and a lower threaded connection, and one or more radial protrusions; and a stabbing guide comprising a sleeve portion, having one or more recesses therein to receive the one or more radial protrusions, and a housing, the stabbing guide securable to the saver sub with the at least a portion of the lower threaded connection of the saver sub receivable within the sleeve portion and the housing disposed to guide a tubular segment connection to the saver sub in the sleeve portion.

11. The apparatus of claim 10 wherein the stabbing guide comprises a pair of halves securable one to the other to form the sleeve portion when the halves are placed on opposing sides of the saver sub.

12. The apparatus of claim 10 wherein the halves of the stabbing guide are securable one to the other to form the sleeve portion by a larger sleeve is slidably received onto the sleeve portion of the stabbing guide.

13. The apparatus of claim 10 wherein the one or more recesses in which the one or more radial protrusions may be received are opened to form one or more windows in the sleeve portion of the stabbing guide.

14. An apparatus to make-up connections with a top drive on a rig comprising:

a saver sub having a first end having a threaded female member connectable to a top drive and a second end having a threaded male member connectable to a tubular segment; and a stabbing guide securable to rotate with the saver sub and to receive and align the end of the tubular segment, the stabbing guide having an elongated sleeve portion at a first end to receive the threaded male member of the saver sub and a housing at a second end to direct a female connection of the tubular segment to the threaded male member of the saver sub;

wherein one of the saver sub or the stabbing guide comprises one or more protrusions, and the other of the saver sub or the stabbing guide comprises one or more recesses to receive the one or more protrusions to prevent rotation of the stabbing guide relative to the saver sub.

15. A method of making-up threaded tubular connections using a top drive comprising the steps of:

coupling an upper threaded connection at a proximal end of a saver sub to a quill of the top drive;

coupling a sleeve portion at a proximal end of a stabbing guide to the saver sub to rotate with the quill and the saver sub, and to dispose a housing at a distal end of the stabbing guide to receive an upper end of a tubular string;

lowering the top drive to engage the upper end of the tubular string with the housing;

continuing to lower the top drive unit to guide the upper end of the tubular string toward a lower threaded connection at a distal end of the saver sub;

rotating the quill and the saver sub relative to the tubular string to make-up a threaded connection between the upper end of the tubular string and the lower threaded connection of the saver sub;

raising the top drive unit and the tubular string to unload a spider on a rig;

lowering the top drive unit to install the tubular string in a borehole;

rotating the saver sub to uncouple the saver sub from the tubular string; and raising the top drive unit to separate the saver sub from the tubular string.

16. An apparatus to make-up connections using a top drive on a rig comprising:

a saver sub having a first end connectable to the top drive and a second end connectable to an end of a tubular segment; and a stabbing guide securable to the saver sub to receive and align the end of the tubular segment, the stabbing guide having sleeve portion at a first end to receive the saver sub and a housing at a second end to direct the end of the tubular segment to the second end of the saver sub wherein one of the saver sub or the stabbing guide comprises one or more protrusions, and the other of the saver sub or the stabbing guide comprises one or more recesses to receive the one or more protrusions to restrict rotation of the stabbing guide relative to the saver sub.

17. A method of making-up threaded tubular connections using a top drive comprising the steps of:

providing a saver sub having a first threaded connection at a first end and a second threaded connection at a second end;

threadably connecting the first threaded connection of the saver sub to a quill of the top drive;

disposing a stabbing guide having a sleeve portion at a proximal end and a housing at a distal end; and releasably securing the sleeve portion of the stabbing guide to the saver sub.

18. The method of claim 17 further comprising the steps of:

supporting a tubular string within a borehole using a spider aligned with the quill of the top drive and engaging the tubular string beneath an upper threaded end of the tubular string;

lowering the top drive to receive the upper threaded end of the tubular string within the housing; and continuing to lower the top drive to guide the upper end of the tubular string to the second threaded connection at the second end of the saver sub.

19. The method of claim 18 further comprising the step of:

rotating the quill of the top drive and the saver sub to make-up a threaded connection between the saver sub and the upper end of the tubular string.

20. The method of claim 19 further comprising the steps of:

raising the top drive to unload the spider;

lowering the top drive to lower the tubular string into the borehole;

reengaging the tubular string with the spider;

continuing to lower the top drive to load the spider;

rotating the quill of the top drive to break-out the threaded connection between the saver sub and the upper end of the tubular string; and raising the top drive to separate the saver sub from the tubular string.

21. The method of claim 17 wherein the step of releasably securing the stabbing guide to the saver sub comprises receiving a protrusion into a recess;

wherein one of the saver sub or the stabbing guide comprises the protrusion, and the other of the saver sub or the stabbing guide comprises one or more recesses to receive the protrusion to restrict rotation of the stabbing guide relative to the saver sub.

22. The method of claim 21 wherein the recess is disposed in the sleeve portion of the stabbing guide.

23. A method of re-machining a worn threaded connection on a saver sub comprising the steps of:

removing a releasably securable stabbing guide from an installed position surrounding at least a portion of the saver sub;

disconnecting the worn saver sub from a quill of the top drive;

connecting a re-machined saver sub to the quill of the top drive; and releasably securing the stabbing guide to the re-machined saver sub.

24. The method of claim 23 further comprising the steps of:

re-machining the worn threaded connection of the saver sub to provide the re-machined saver sub.

25. The method of claim 23 wherein the removing step comprises the removal of a radial protrusion from a recess in which the protrusion is received to rotatably secure the stabbing guide to the saver sub.

26. A method of assembling a stabbing guide comprising the steps of:

surrounding a saver sub, having a first threaded connection at a first end and a second threaded connection at a second end, with a stabbing guide having a sleeve portion at a proximal end and a housing at a distal end; and releasably securing the stabbing guide to the saver sub.

27. The method of claim 26 wherein the releasably securing step comprises:

receiving one or more protrusions on one of the saver sub or the stabbing guide into one or more recesses on the other of the saver sub or the stabbing guide.

* * * * *

UNITED STATES PATENT AND TRADEMARK OFFICE

CERTIFICATE OF CORRECTION

PATENT NO. : 7,490,677 B2
APPLICATION NO. : 11/428712
DATED : February 17, 2009
INVENTOR(S) : Jean Buytaert et al.

It is certified that error appears in the above-identified patent and that said Letters Patent is hereby corrected as shown below:

Col. 6, Line 46 - 50,
Delete from claim 1 the second occurrence of the limitation:

"and one or more radially projecting protrusions on the saver sub receivable within one or more recesses in the sleeve portion of the stabbing guide to rotatably secure the saver sub to the stabbing guide;"

Col. 8, Line 31,
Add to claim 16 a semi-colon before "wherein."

Col. 8, Line 43,
In claim 17, replace "disposing" with "providing."

Signed and Sealed this

Twenty-first Day of April, 2009

John Doll

JOHN DOLL
*Acting Director of the United States Patent and Trademark Office*